US006412136B1

(12) United States Patent
Rutkowski

(10) Patent No.: US 6,412,136 B1
(45) **Date of Patent: *Jul. 2, 2002**

(54) DRAIN CLEANING APPARATUS

(75) Inventor: Michael J. Rutkowski, Brunswick, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/906,178

(22) Filed: Jul. 16, 2001

Related U.S. Application Data

(63) Continuation of application No. 09/718,067, filed on Nov. 22, 2000, now abandoned, which is a continuation of application No. 09/459,587, filed on Dec. 13, 1999, now Pat. No. 6,243,905, which is a continuation of application No. 09/116,225, filed on Jul. 16, 1998, now Pat. No. 6,009,588.

(51) Int. Cl.[7] ..... B08B 9/02

(52) U.S. Cl. ..... 15/104.33; 226/35; 226/154; 242/364.4; 254/134.3 FT

(58) Field of Search ..... 15/104.31, 104.32, 15/104.33; 226/35, 154, 155; 242/390, 390.3, 564.3, 564.4; 254/134.3 FT

(56) References Cited

U.S. PATENT DOCUMENTS

| | | | | |
|---|---|---|---|---|
| 1,076,870 A | * 10/1913 | Dahl | ..... | 254/134.3 FT |
| 2,090,174 A | 8/1937 | Albright | ..... | 464/7 |
| 2,167,268 A | 7/1939 | Sanger | ..... | 15/104.33 |

(List continued on next page.)

FOREIGN PATENT DOCUMENTS

| | | | | |
|---|---|---|---|---|
| AU | 477023 | * 5/1975 | ..... | 242/564.4 |
| EP | 0 443 290 A3 | 8/1991 | | |
| GB | 2117078 | 10/1983 | | |

(List continued on next page.)

OTHER PUBLICATIONS

Copies of five (5) photographs numbered 1 through 5 of a commercial snake feed mechanism designated "Mini Dual Feed" of Marco Products Company of Los Angeles, California.
Unnumbered and undated pages from a product and parts catalog of Marco Products Company of Los Angeles, California.
General Wire (2 pages).
Marco Brochure (5 pages).
Milwaukee 0567–1 (1 page).
Milwaukee 0564–1 (1 page).
Rioned (2 pages).
Cobra (2 pages).
Sureflow 50' Power Snake (1 page).
Gorlitz (2 pages).
Flexible Mini–zapper DZ–1 (2 pages).
Copies of 5 photographs (numbered 1–5) of a Commercial Snake Feed Mechanism Designated "Mini Dual Feed" of Marco Products Company.
Rottenberger Uniflex N30 (1 page).
National D–50 Drain Cleaner (2 drawings).
O'Brien Root Master (2 pages).
1995 Spartan Catalogue.

*Primary Examiner*—Mark Spisich
(74) *Attorney, Agent, or Firm*—Vickers, Daniels & Young

(57) ABSTRACT

The inner end of a snake or drain cleaning cable coiled in a rotatable cable storage drum of drain cleaning apparatus is provided with a torque arm which frictionally engages the outer wall of the drum to restrain sliding of the cable relative thereto during a drain cleaning operation. The drain cleaning apparatus is motor driven, and a cable feed device for axially displacing the cable relative to the storage drum is provided on the outer end of a flexible guide tube detachably mounted on the apparatus to facilitate an operator guiding the outer end of the cable into a drain to be cleaned and advancing or retracting the cable relative to the apparatus without having to physically contact the cable.

38 Claims, 8 Drawing Sheets

U.S. PATENT DOCUMENTS

| | | | | |
|---|---|---|---|---|
| 2,267,493 | A | 12/1941 | Clotz | 15/104.33 |
| 2,272,387 | A | 2/1942 | Therrien | 15/104.33 |
| 2,318,172 | A | 5/1943 | Long | 15/104.33 |
| 2,355,733 | A | 8/1944 | Johnson et al. | 15/104.33 |
| 2,431,089 | A | 11/1947 | Therrien | 15/104.33 |
| 2,467,849 | A | 4/1949 | O'Brien et al. | 15/104.33 |
| 2,468,490 | A | 4/1949 | Di Joseph | 15/104.33 |
| 2,600,707 | A | 6/1952 | Turnbaugh | 15/104.33 |
| 2,769,191 | A | 11/1956 | Hunt et al. | 15/104.33 |
| 2,926,372 | A | 3/1960 | O'Brien | 15/104.33 |
| 2,953,799 | A | 9/1960 | Arnold | 15/104.33 |
| 3,007,186 | A | 11/1961 | Olsson | 15/104.33 |
| 3,093,854 | A | 6/1963 | Silverman | 15/104.33 |
| 3,159,861 | A | 12/1964 | Sarcone | 15/104.33 |
| 3,206,782 | A | 9/1965 | Larsen | 15/104.33 |
| 3,224,024 | A | 12/1965 | Hunt | 15/104.33 |
| 3,268,937 | A | 8/1966 | Bollinger | 15/104.33 |
| 3,283,353 | A | 11/1966 | Kirk | 15/104.33 |
| 3,329,044 | A | 7/1967 | Singer | 15/104.33 |
| 3,370,599 | A | 2/1968 | Ciaccio | 15/104.33 X |
| 3,394,599 | A | 7/1968 | Tucker | 74/25 |
| 3,444,578 | A | 5/1969 | Caperton | 15/104.31 |
| 3,449,782 | A | 6/1969 | Hunt | 15/104.33 |
| 3,451,089 | A | 6/1969 | Carlson et al. | 15/104.33 |
| 3,497,899 | A | 3/1970 | Caperton | 15/104.31 |
| 3,609,788 | A | 10/1971 | Mier | 15/104.33 |
| 3,612,487 | A | 10/1971 | Raney et al. | 254/269 |
| 3,673,627 | A | 7/1972 | Caperton | 15/104.33 |
| 3,691,583 | A | 9/1972 | Silverman et al. | 15/104.33 |
| 3,703,015 | A | 11/1972 | Naeve | 15/104.33 |
| 3,776,179 | A | 12/1973 | Raney et al. | 118/708 |
| 3,809,366 | A | 5/1974 | Crees | 254/134.3 FT |
| 3,882,565 | A | 5/1975 | Irwin et al. | 15/104.33 |
| 3,897,602 | A | 8/1975 | Waterbury | 15/104.33 |
| 3,928,885 | A | 12/1975 | Peterson et al. | 15/104.33 |
| 3,958,293 | A | 5/1976 | Irwin | 15/104.33 |
| 4,153,966 | A | 5/1979 | Irwin | 15/104.33 |
| 4,218,802 | A | 8/1980 | Babb et al. | 15/104.33 |
| 4,287,630 | A | 9/1981 | Perez | 15/104.33 |
| 4,291,429 | A | 9/1981 | Servadio | 15/104.33 |
| 4,364,139 | A | 12/1982 | Babb et al. | 15/104.33 |
| 4,395,791 | A | 8/1983 | Irwin | 15/104.33 |
| D271,436 | S | 11/1983 | Babb et al. | D32/14 |
| 4,447,926 | A | 5/1984 | Rothenberger | 15/104.33 |
| 4,570,281 | A | 2/1986 | Boelens | 15/104.33 |
| 4,580,306 | A | 4/1986 | Irwin | 15/104.33 |
| 4,611,360 | A | 9/1986 | Irwin | 15/104.33 |
| 4,617,693 | A | 10/1986 | Meyer et al. | 15/104.33 |
| 4,686,732 | A | 8/1987 | Irwin | 15/104.33 |
| 4,763,374 | A | 8/1988 | Kaye | 15/104.33 |
| 4,773,113 | A | 9/1988 | Russell | 15/4 |
| 4,819,292 | A | 4/1989 | Kerr | 15/104.33 |
| 4,837,887 | A | 6/1989 | McLaughlin | 15/104.33 |
| 4,914,775 | A | 4/1990 | Kirk | 15/104.33 |
| 4,956,889 | A | 9/1990 | Kirk | 15/104.33 |
| 5,029,356 | A | 7/1991 | Silverman et al. | 15/104.33 |
| 5,031,263 | A | 7/1991 | Babb et al. | 15/104.33 |
| 5,031,276 | A | 7/1991 | Babb et al. | 15/104.33 |
| 5,181,668 | A | 1/1993 | Tsuji et al. | 242/387 |
| 5,193,242 | A | 3/1993 | Irwin | 15/104.33 |
| 5,199,129 | A | 4/1993 | Salecker et al. | 15/104.33 |
| 5,222,270 | A | 6/1993 | Sloter et al. | 15/104.33 |
| 5,235,718 | A | 8/1993 | Grimsley et al. | 15/104.095 |
| 5,239,724 | A | 8/1993 | Salecker et al. | 15/104.33 |
| 5,265,301 | A | 11/1993 | Irwin | 15/104.33 |
| 5,309,595 | A | 5/1994 | Salecker et al. | 15/104.33 |
| 5,329,662 | A | 7/1994 | Salecker | 15/104.31 |
| 5,333,448 | A | 8/1994 | Salecker | 15/104.09 X |
| 5,335,388 | A | 8/1994 | Salecker | 15/104.31 X |
| 5,379,476 | A | 1/1995 | Salecker | 15/104.31 |
| 5,390,389 | A | 2/1995 | Rutkowski et al. | 15/104.33 |
| 5,414,888 | A | 5/1995 | Irwin | 15/104.33 |
| 5,507,062 | A | 4/1996 | Salecker | 15/104.33 |
| 5,535,473 | A | 7/1996 | Maniar | 15/104.33 |
| 5,618,123 | A | 4/1997 | Pulse | 15/104.33 X |
| 5,640,736 | A | 6/1997 | Salecker | 15/104.33 |
| 6,003,842 | A | * 12/1999 | Hug | 254/134.3 FT |

FOREIGN PATENT DOCUMENTS

| | | |
|---|---|---|
| GB | 2122712 | 1/1984 |
| JP | 50-139471 | 4/1974 |
| JP | 50-109466 | 8/1975 |
| JP | 51-046761 | 8/1975 |
| JP | 52-112266 | 9/1977 |
| JP | 54-162853 | 12/1979 |
| JP | 55-039283 | 3/1980 |
| JP | 57-071942 | 5/1982 |
| JP | 58-049828 | 3/1983 |
| JP | 60-179184 | 9/1985 |
| JP | 62-227481 | 10/1987 |
| JP | 50-086164 | 4/1993 |

* cited by examiner

DRAIN CLEANING APPARATUS

This application is a continuation of application Ser. No. 09/718,067 filed Nov. 22, 2000, abandoned, which is a continuation of application Ser. No. 09/459,587 filed Dec. 13, 1999 now U.S. Pat. No. 6,243,905, which is a continuation of application Ser. No. 09/116,225 filed Jul. 16, 1998 now U.S. Pat. No. 6,009,588.

BACKGROUND OF THE INVENTION

This invention relates to the art of drain cleaning apparatus and, more particularly, to improvements in connection with transmitting torque to the drain cleaning cable in such apparatus and directing and feeding the cable into a drain or waste line to be cleaned.

Drain cleaning apparatus of the character to which the present invention is directed is generally comprised of a motor driven snake or drain cleaning cable drum in which the drain cleaning cable is wound about the axis of the drum and is rotatable therewith. The drum has an open front end through which a free or outer end of the cable extends for entrance into a drain to be cleaned and, in order to optimize the torque transmitted to the cable by rotation of the drum, cable guide tubes have been provided in the drum, or the inner end of the cable has been clamped to the drum. Guide tube arrangements are structurally complex and require somewhat complicated mountings in the drum, and cable clamps require mounting holes through the drum which leads to water leakage relative to the drum. While it is preferred to avoid the foregoing problems by eliminating the guide tube or not attaching the inner end of the cable to the drum, the result is that the slippage between the cable and drum restricts the transmission of torque to the cable by the drum and thus restricts the magnitude of a blockage which can be broken up or cleared with the apparatus.

The snake or drain cleaning cable in such apparatus, as is conventional, is an elongate, flexible member made of tightly wound spring wire, and the free or outer end thereof is adapted to be pulled from or pushed back into the drum in which the cable is stored during periods of non-use. In many such apparatus, the drum, or a cable cartridge within the drum, can be removed to facilitate connecting successive lengths of cable for feeding into a waste line, or for using different diameter drain cleaning cables with the apparatus. Often, drain cleaners of the foregoing character not only require that the cable be manually pulled or pushed relative to the cable drum housing, but also require the operator to manually bend or flex the cable in order to direct it into the entrance of a drain or waste line to be cleaned. Even though an operator may wear gloves, whereby his or her hands are protected from dirt and/or abrasive contact with the drain cleaning cable, such protection is not obtained in the absence of gloves and, in any event, pulling, pushing and flexing the cable into position is inconvenient for the operator.

SUMMARY OF THE INVENTION

In accordance with the present invention, improvements are provided by which the foregoing and other problems encountered with motor driven drain cleaning apparatus are minimized or overcome. In accordance with one aspect of the invention, the torque transmitted from a cable storage drum or cartridge to a cable having its inner end detached from the drum is considerably increased over that heretofore obtainable. In this respect, the inner end of a drain cleaning cable in a storage drum or cartridge is provided with an attachment which frictionally engages the inner surface of the storage container to resist slippage therebetween and thus increase the torque transmitted to the cable during operation of the apparatus.

In accordance with another aspect of the invention, the outer or free end of a drain cleaning cable extends through a flexible guide tube which is provided on its outer end with a manually operable device for feeding the cable from and to the storage drum, thus to preclude an operator having to manually pull or push the cable relative to the drum. Moreover, the flexibility of the guide tube advantageously enables the operator to direct the free end of the cable into a drain or waste line to be cleaned, whereby both the entrance of the cable into the drain opening and the advancement thereof during the cleaning operation can be achieved without the operator having to touch the cable. Accordingly, the drain cleaning apparatus is more convenient to use than apparatus heretofore available, and the cleaning operation is achieved more quickly and more efficiently than heretofore possible as a result of the flexible guide tube and cable feeding components. Preferably, the flexible guide tube and cable feed device, or the cable feed device alone, are selectively mountable on the apparatus for use with the drain cleaning cable thereof, thereby providing versatility with respect to the options available to an operator in connection with use of the apparatus.

It is accordingly an outstanding object of the present invention to provide improvements in connection with drain cleaning apparatus of the character comprising a motor driven storage drum in which a drain cleaning cable is coiled about the axis of the drum and has a free or outer end extending outwardly of the drum for entry into a drain or waste line to be cleaned.

Another object is the provision of drain cleaning apparatus of the foregoing character in which the inner end of the drain cleaning cable coiled in the drum is detached therefrom and provided with an arrangement for frictionally interengaging with the drum in a manner to increase the transmission of torque to the cable relative to such apparatus heretofore available in which the inner end of the cable is detached from the drum.

Still another object is the provision of apparatus of the foregoing character in which the outer or free end of the drain cleaning cable can be displaced relative to the storage drum and into the entrance of a drain or waste line to be cleaned without hand contact of the cable by the operator.

A further object is the provision of drain cleaning apparatus of the foregoing character in which a manually operable drain cleaning cable feed device is selectively attachable to the apparatus alone or through the use of a flexible guide tube, thus promoting versatility with respect to use of the apparatus by an operator and enabling the extension and retraction of the cable relative to the storage drum and direction of the cable into the inlet end of a drain to be cleaned without hand contact of the cable by the operator.

Yet another object is the provision of apparatus of the foregoing character which is more convenient to use than similar apparatus heretofore available and which is more efficient in connection with achieving a drain or waste line cleaning operation.

BRIEF DESCRIPTION OF THE DRAWINGS

The foregoing objects, and others, will in part be obvious, and in part pointed out more fully hereinafter in conjunction with the written description of preferred embodiments of the invention illustrated in the accompanying drawings in which.

DESCRIPTION OF PREFERRED EMBODIMENTS

Figure 1:
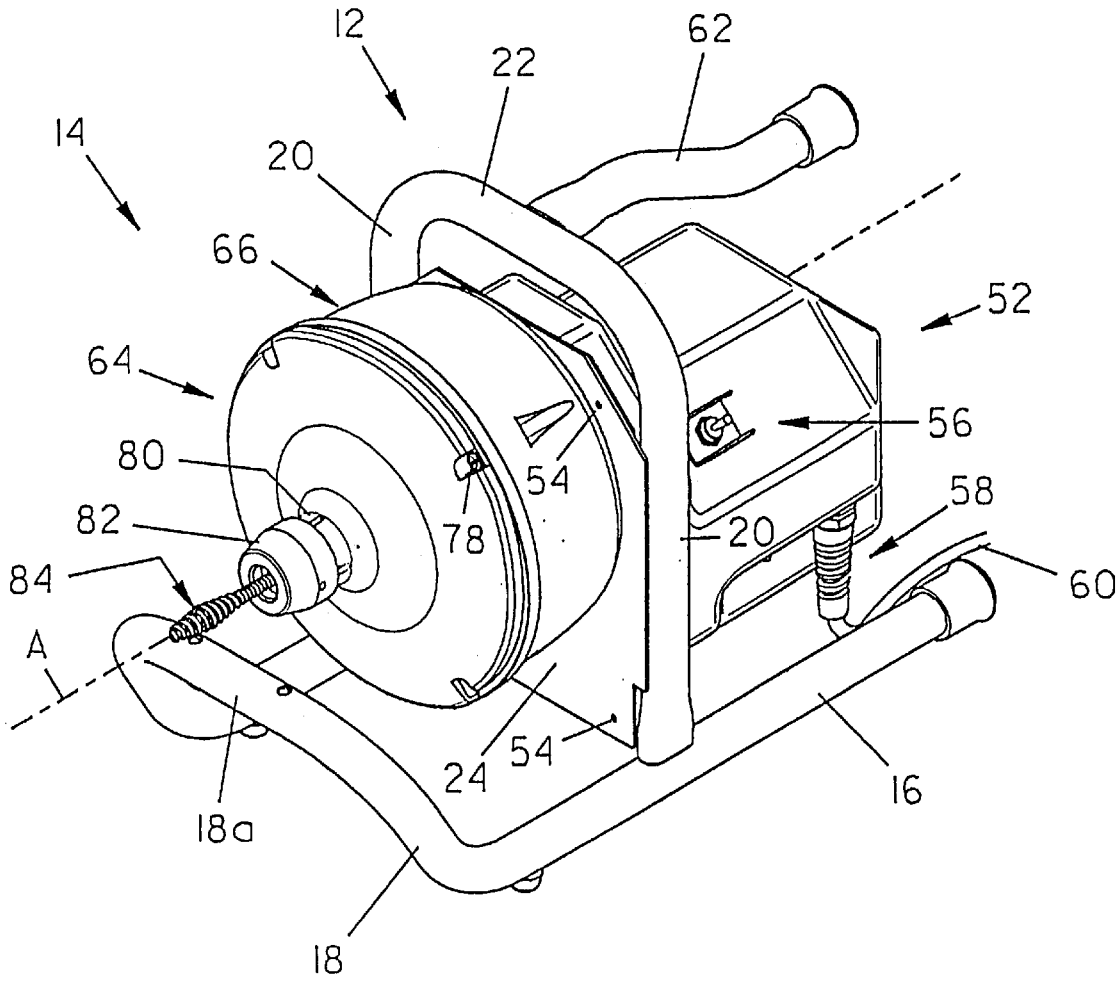
FIG. 1 is a perspective view of drain cleaning apparatus in accordance with the present invention.
Figure 2:
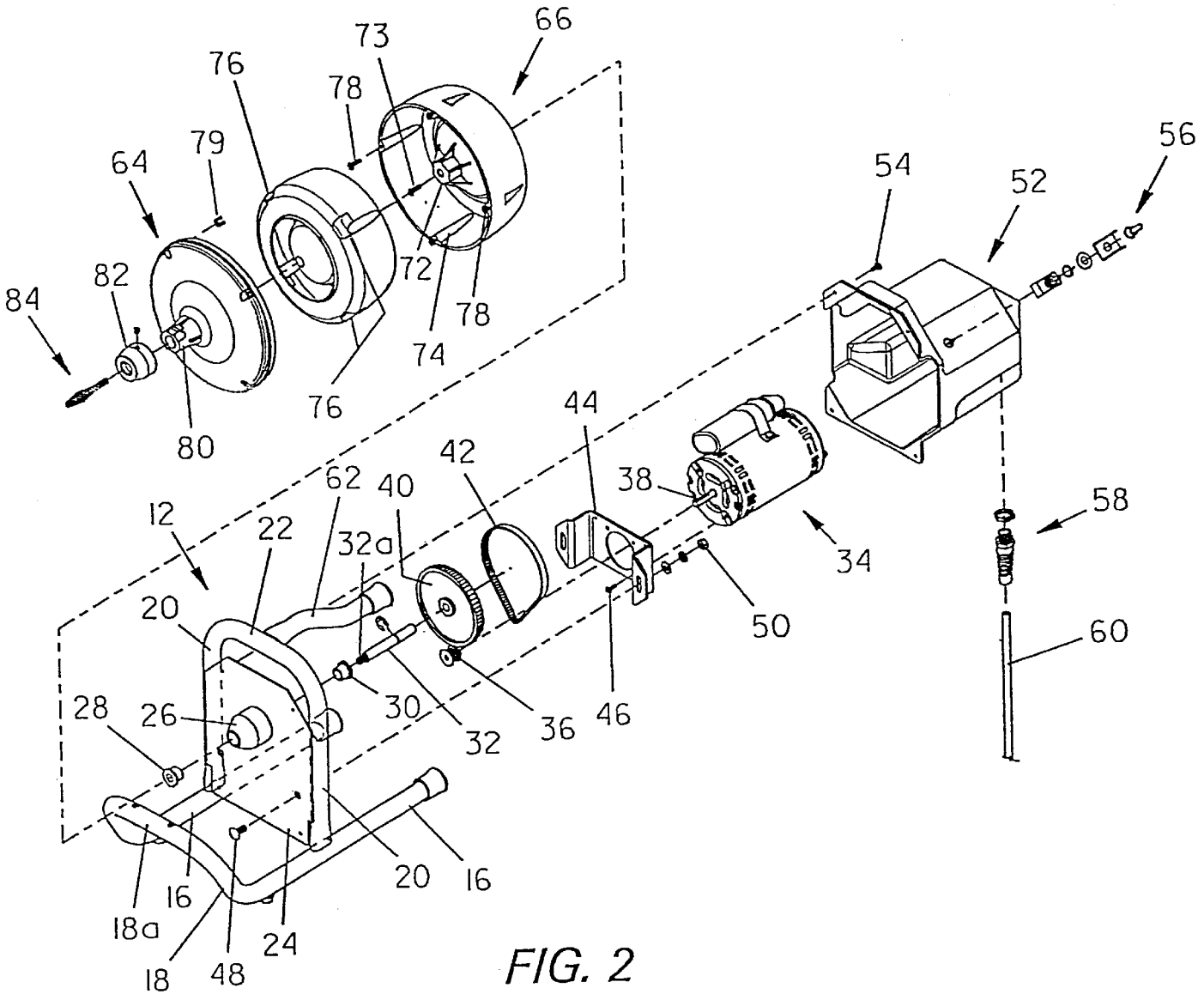
FIG. 2 is an exploded perspective view of the apparatus shown in FIG. 1.

Referring now in greater detail to the drawings, wherein the showings are for the purpose of illustrating preferred embodiments of the invention only and not for the purpose of limiting the invention, FIGS. 1 and 2 illustrate drain cleaning apparatus comprising a frame 12 which supports a cable drum assembly 14 for rotation about a cable drum axis A. Frame 12 comprises a tubular metal base portion having laterally spaced apart legs 16 interconnected at their forward ends by a U-shaped bridging portion 18 which inclines upwardly and forwardly relative to legs 16. The frame further includes an inverted U-shaped tubular metal frame member having laterally spaced apart legs 20 welded to and extending upwardly from legs 16 of the base portion of the frame and having a bridging portion 22 between the upper ends of the legs, and a mounting and support plate 24 which extends between and is welded or otherwise secured to legs 20. Cable drum assembly 14 is supported on plate 24 for rotation about axis A by a bearing support member 26 which is welded on plate 24, bearing sleeves 28 and 30 received in axially opposite ends of member 26, and a drum shaft 32 rotatably supported by the bearing sleeves and interconnected with the drum assembly as set forth hereinafter. Drum shaft 32 is adapted to be driven by a reversible motor 34 through a pulley and endless belt unit including a pulley 36 mounted on and driven by motor shaft 38, a pulley 40 mounted on the inner end of drum shaft 32 and interconnected therewith such as by a flat so as to rotate the drum shaft, and an endless belt 42 trained about pulleys 36 and 40. Motor 34 is attached to a motor mounting plate 44 by means of a plurality of button head screws 46, and mounting plate 44 is secured to mounting and support plate 24 of the frame by carriage bolts 48 and nuts 50. The drive motor, pulleys and drive belt are enclosed in a housing 52 which is attached to support plate 24 by a plurality of threaded fasteners 54, and housing 52 supports a toggle switch unit 56 for controlling motor 34 and a flexible protective sleeve 58 through which motor power cord 60 extends for connection to a source of AC current. Preferably, frame 12 includes a handle 62 which extends rearwardly over housing 52 and by which the apparatus can be carried.

Figure 3:
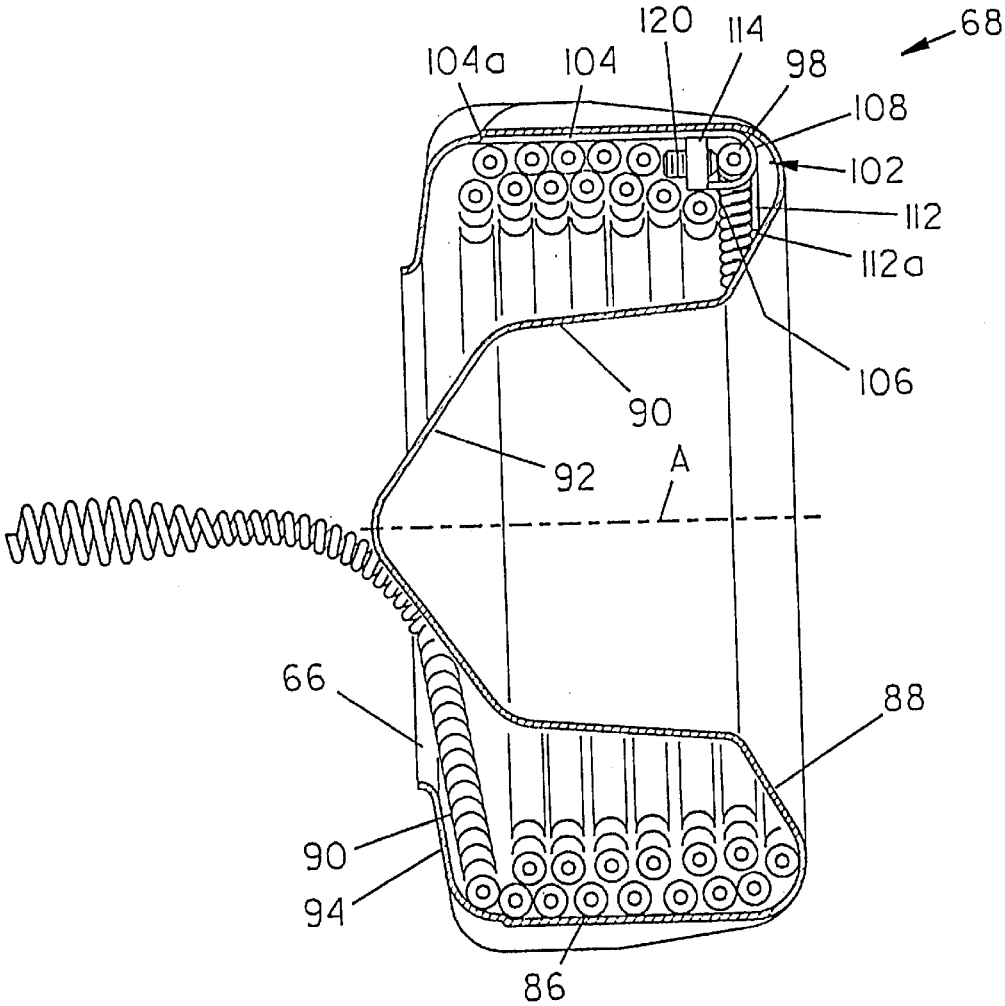
FIG. 3 is a sectional elevation view through the cable cartridge component of the drum assembly and showing a torque arm on the inner end of the cable in accordance with the invention.

Cable drum assembly 14 comprises front and rear cable drum housing members 64 and 66, respectively, and an intermediate cable cartridge 68 in which, as will be appreciated from FIG. 3, a drain cleaning snake or cable 70 is coiled about axis A. Rear housing member 66 includes a hub 72 which is internally threaded on the inner or rear end thereof to interengage with threaded axially outer end 32*a* of drum shaft 32 so as to mount the cable drum assembly on shaft 32 for rotation therewith. Rear housing 66 is further secured to drum shaft 32 by a flat head screw 73 which extends through an opening therefor in hub 72 and into a threaded bore in end 32*a* of the drum shaft. Rear housing member 66 further includes radially inwardly extending ribs 74 which axially slidably interengage with recesses 76 in the outer periphery of cartridge 68 so as to engage the latter with housing member 66 for rotation therewith. Cartridge 68 is axially retained in rear housing member 66 by front housing member 64 which is secured to housing member 66 by a plurality of headed fasteners 78 in the outer ends of ribs 74 and drum clips 79 mounted on front housing member 64 and providing bayonet slots for fasteners 78. Front housing member 64 has a forwardly extending hub 80 to which an exit collar 82 is secured by means of a set screw, not designated numerically, and cable 70 extends through the hub and exit collar drum from cartridge 68 and has a free or outer end 84 for entry into a drain or waste line to be cleaned. Accordingly, it will be appreciated that the hub and exit collar provide an opening at the front of cable drum assembly 14 through which the free end of the drain cleaning cable extends for entry into a drain to be cleaned.

In the embodiment illustrated in the drawings, and as best seen in FIG. 3, cable drum cartridge 68 includes an outer peripheral wall 86, a closed inner or rear end defined by a peripheral wall 88 extending radially inwardly from wall 86 and an axially forwardly extending peripheral wall 90 spaced radially inwardly from outer wall 86 and terminating in a cone-shaped forward end wall 92, and a front end defined by a peripheral wall 94 extending radially inwardly from outer wall 86. The radially inner end of wall 94 is spaced radially outwardly from cone-shaped wall 92 and provides a peripheral opening therewith through which cable 70 extends for passage through hub 80 and exit collar 82 of the drum assembly. As will be further appreciated from FIG. 3, cable 70 is wound in the cartridge about axis A between the front and rear ends of the cartridge and, as a result of the bias of the spring metal from which the cable is constructed, is biased radially outwardly against wall 86 of the cartridge.

Figure 4:
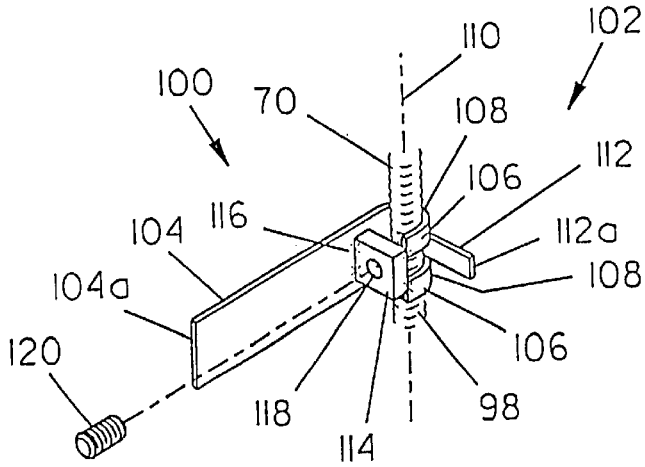
FIG. 4 is a perspective view of the torque arm illustrated in FIG. 3.

In accordance with one aspect of the present invention, and as best seen in FIGS. 3 and 4 of the drawing, cable 70 has an inner end 98 disposed adjacent the juncture between outer wall 86 and rear wall 88 of the cartridge housing and provided with a torque arm 100 which operates as set forth hereinafter to increase the torque applied to cable 70 in response to rotation of the drum assembly during operation of the drain cleaning apparatus. In the embodiment illustrated, torque arm 100 is constructed from a strip of cold rolled steel and has a mounting end 102 by which the torque arm is attached to end 98 of the cable. More particularly, the torque arm comprises an elongate, planar first leg 104 extending from mounting end 102, and the latter is defined by a pair of second legs 106 each of which is parallel to leg 104 and integrally interconnected therewith by a corresponding U-shaped bridging portion 108. Bridging portions 108 provide mounting end 102 of the torque arm with an axis 110 with respect to which legs 106 are spaced apart from one another and, preferably, the torque arm further includes a finger 112 axially between legs 106 and bridging portions 108 and which is integral with first leg 104 and extends perpendicular thereto and tangential to bridging portions 108. A nut or other block member 114 extends between first leg 104 and the free ends of second legs 106 and is securely fastened thereto such as by weldments 116. Block 114 is provided with a threaded opening 118 therethrough extending radially of axis 110 for receiving a threaded fastener 120, such as a set screw, by which the torque arm is removably mounted on end 98 of the drain cleaning cable. It will be appreciated that legs 106, bridging portions 108 and block 114 define a collar on mounting end 102 of the torque arm which snugly receives and surrounds end 98 of the cable and provides axis 110.

As will be appreciated from FIG. 3, leg 104 of the torque arm is adjacent outer wall 86 of the cartridge housing and extends from the juncture between outer wall 86 and rear wall 88 to a point adjacent the juncture between the outer wall and front wall 94. The torque arm is biased radially outwardly by the resiliency and coiled condition of cable 70 in the cartridge housing and frictionally engages outer wall 86 along the length of leg 104 to front edge 104*a* thereof and into the bridging portions 108 at mounting end 102 of the torque arm. Finger 112 extends radially inwardly from mounting end 102 and engages rear wall 88 of the cartridge housing along upper or radially inner edge 112*a* of the finger. Accordingly, it will be appreciated that in response to rotation of the cable drum assembly and thus cartridge housing 68 in connection with a drain cleaning operation, torque arm 100 resists sliding of cable 70 relative to the cartridge housing when an obstruction or the like is encountered by the leading end of the snake which is disposed in the drain or waste line being cleaned. While finger 112 contributes to the resistance to sliding, its primary purpose is to stabilize the torque arm against pivotal movement clockwise in FIG. 3 about axis 110 when the radially outward bias on leg 104 by the cable is reduced, such as when the cable is nearly fully extended from the cartridge housing.

In the embodiment illustrated, the cold rolled steel strip of which the torque arm is constructed has a thickness of 0.06 inch, a width of 0.75 inch and a length of 2.50 inches from axis 110 to edge 104*a* of leg 104. Further, the curvature of bridging portions 106 has a radius of 0.22 inch with respect to axis 110, and finger 112 has a length of 0.69 inch from axis 110 to edge 112*a* of the finger. Each of the legs 106 and finger 112 have a width of 0.25 inch in the direction of axis 110. In a cable drum having the structure described hereinabove and in which the inner end of the drain cleaning cable corresponding to end 98 is not attached to the cartridge housing and does not have a torque arm attached thereto, slippage between the drain cleaning cable and cartridge housing with the free end of the cable held against rotation adjacent exit collar 82 occurs at a torque of between 5 and 10 in.-lbs. In comparison, with a torque arm of the foregoing structure attached to the inner end of the cable, slippage does not occur until a torque of about 35 in.-lbs. is applied to the cable by a cartridge housing.

Figure 5:
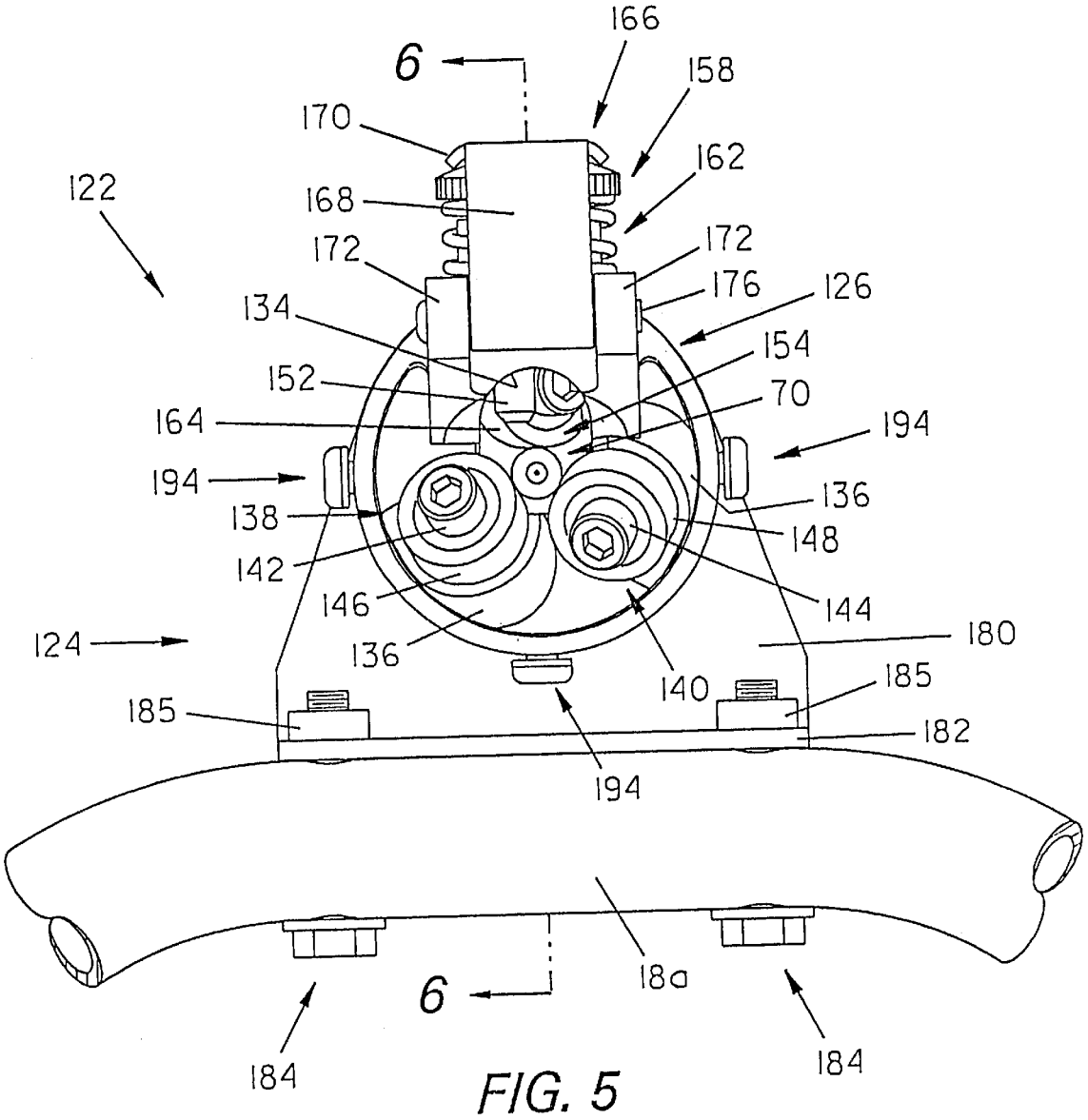
FIG. 5 is an end elevation view showing a manually operable cable feed device mounted on a frame component of the apparatus illustrated in FIG. 1.
Figure 6:
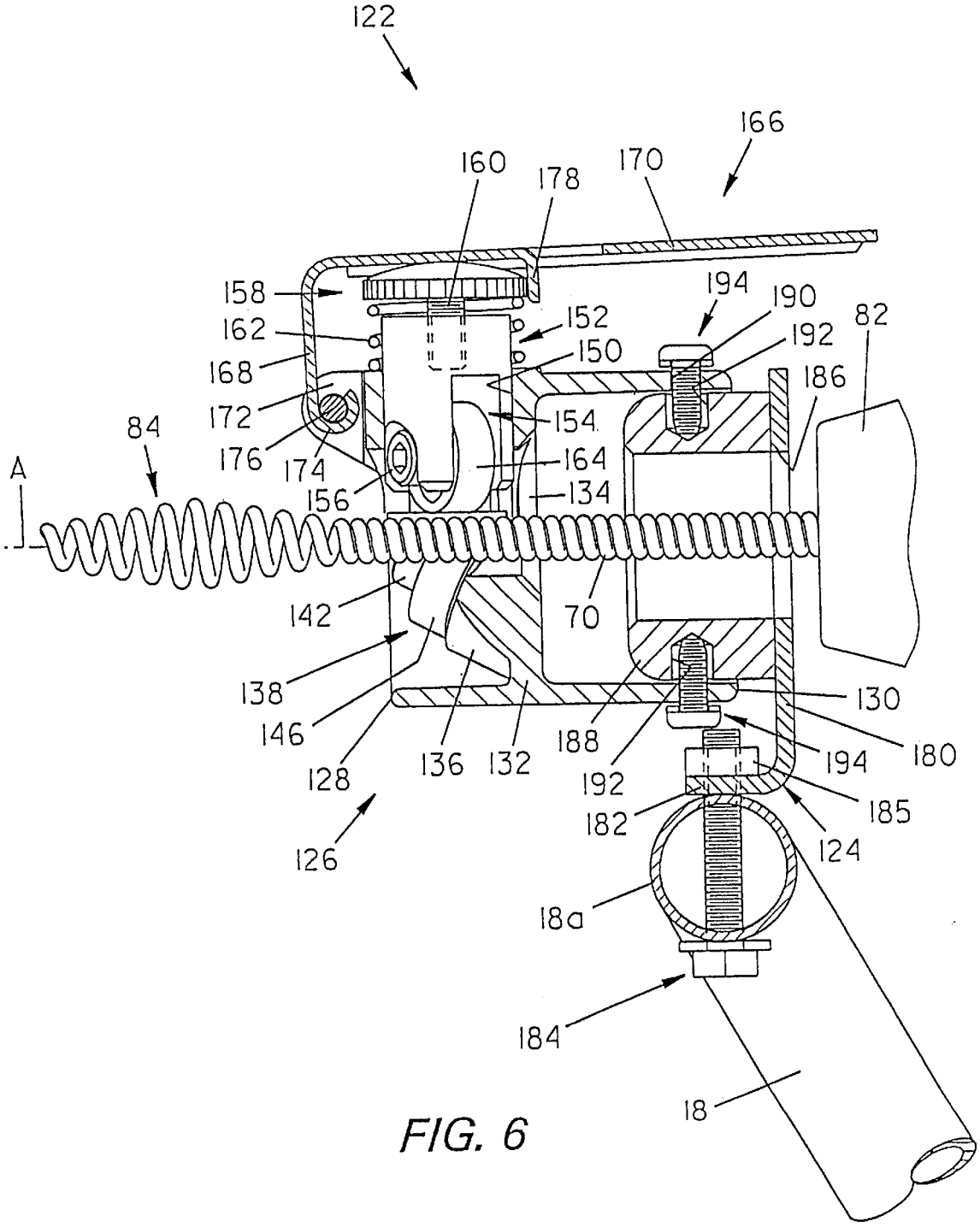
FIG. 6 is a sectional elevation view of the cable feed device taken along lines 6—6 in FIG. 5.

In accordance with another aspect of the invention, as shown in FIGS. 5 and 6 of the drawing, U-shaped portion 18 of the base of frame 12 includes a portion 18*a* extending horizontally across the front end of drum assembly 14 below exit collar 82 thereof, and a manually operable cable feed device 122 is mounted on frame portion 18*a* by means of a mounting bracket 124 to facilitate the selective feeding of drain cleaning cable 70 outwardly and inwardly relative to drum assembly 14. Cable feed device 122 corresponds structurally and functionally to the cable feed device disclosed in co-pending patent application Ser. No. 901,653, now U.S. Pat. No. 5,901,401, filed Jul. 28, 1997 in the names of Michael J. Rutkowski and Jon R. Dunkin and assigned to the same assignee as the present application. While cable feed device 122 will be described herein in considerable detail, the foregoing co-pending application is hereby incorporated herein by reference and can be referred to for further structural detail. FIGS. 5 and 6 in the present application correspond respectively to FIGS. 2 and 4 in the foregoing co-pending application.

As shown in FIGS. 5 and 6, cable feed device 122 comprises a tubular housing 126 having an axis coinciding with axis A of the apparatus and axially opposite front and rear ends 128 and 130, respectively. Housing 126 includes a wall 132 therein transverse to axis A and having a passage 134 for receiving cable 70. Wall 132 includes roll mounting nodes 136 on the front side thereof, and the feed device includes a pair of cable driving rolls 138 and 140 mounted on nodes 136 by socket head cap screws 142 and 144, respectively. The cap screws provide axes for rotation of the respective driving rolls, and each driving roll axis is skewed both horizontally and vertically relative to the housing axis. Driving rolls 138 and 140 have smooth outer surfaces 146 and 148, respectively, and the skewed mounting thereof provides for driving drain cleaning cable 70 in a well known manner when the cable is rotated and displaced against the driving rolls. Housing 126 further includes a radially extending bore 150 having an inner end which opens into cable passage 134 and which slidably and removably receives a cable drive actuating unit including a drive actuating roll support member 152. Support member 152 has a radially inner end on which a drive actuating roll 154 is mounted by means of a socket head cap screw 156 which provides an axis for the drive actuating roll, and an axially outer end on which an operating knob member 158 is mounted by way of a threaded stem 160 received in a threaded recess therefor in roll support member 152, not designated numerically. Operating knob member 158 is axially adjustable relative to roll support member 152 for adjusting the axial length of the drive actuating unit, and a compression spring 162 surrounds the roll support member between the radially outer end of bore 150 and the underside of operating knob member 158 to bias the drive actuating unit radially outwardly of the housing. Drive actuating roll 154 has a smooth outer surface 164 and, as will be appreciated from FIG. 5, the driving rolls and actuator drive roll are equally spaced apart circumferentially about axis A. Further, drive actuating roll support member 152 supports drive actuating roll 154 in housing 126 for the axis of the drive actuating roll to be skewed horizontally with respect to axis A, preferably at the same angle as that of driving rolls 138 and 140 which, preferably, is 30° with respect to both the horizontal and vertical directions of the skew thereof.

The drive actuating unit of feed device 122 is adapted to be displaced radially inwardly of housing 126 against the bias of spring 162 by means of an operating lever 166 which includes a mounting leg 168 and a handle portion 170 extending perpendicular thereto. The front end of housing 126 is provided with a pair of lever mounting ears 172, and mounting leg 168 of the lever is received between ears 172 and has a rolled tubular lower end 174 receiving a pivot pin 176 extending through openings therefor in ears 172 to provide a lever pivot axis transverse to and laterally spaced from axis A. Handle portion 170 extends across the outer surface of operating knob member 158 and is provided with a finger 178 which frictionally engages with the peripheral outer surface of the knob member to releasably hold the drive actuating unit in bore 150 and to restrain rotation of the operating knob member relative to drive actuating roll support member 152.

As mentioned above, cable feed device 122 is adapted to be mounted on frame portion 18*a* by means of a mounting bracket 124. As seen in FIGS. 5 and 6, mounting bracket 124 includes an L-shaped bracket plate having a vertical leg 180 and a horizontal leg 182 extending forwardly from the lower end thereof and secured to frame portion 18*a* such as by a pair of bolts 184 extending upwardly through openings therefor in frame portion 18*a* and into threaded engagement with nuts 185 welded on leg 182 of the bracket plate. Leg 180 is provided with an opening 186 coaxial with axis A, and the mounting bracket further includes an annular adaptor sleeve 188 mounted on the front side of leg 180 such as by welding and so as to be coaxial with axis A. Inner end 130 of housing 126 of the cable feed device axially receives adaptor sleeve 188 therein, and the housing is provided with diametrically opposed pairs of openings 190 adapted to be aligned with corresponding bores 192 in the radially outer side of adaptor sleeve 188. Openings 190 are internally threaded to receive the threaded shanks of bolts 194 by which housing 126 and thus feed device 122 is removably mountable on the drain cleaning apparatus.

In operation of the feed device, the component parts thereof are initially in the positions shown in FIG. 6, whereby cable 70 rotates relative to housing 126 in response to rotation of the cable drum assembly. There is no axial displacement of the cable at this time in that actuating drive roll 154 is disengaged from the cable. When handle 170 of lever 166 is displaced clockwise from the position shown in FIG. 6, drive actuator roll 154 is displaced radially inwardly against cable 70 to displace the latter against drive rolls 138 and 140 as shown in FIG. 5. As a result of the skewed disposition of the rolls, they interengage with the rotating cable to cause the latter to advance axially of housing 126 in the direction relative to the housing which depends on the direction of rotation of the cable. In this respect, rotation of the cable in one direction advances the latter axially outwardly from front end 128 of the housing while rotation of the cable in the opposite direction draws the cable axially inwardly of the housing. When it is desired to stop axial displacement of the cable in either direction, handle 170 is released for spring 162 to return the drive actuating unit to the position thereof shown in FIG. 6 and in which roll 154 disengages the cable.

Figure 7:
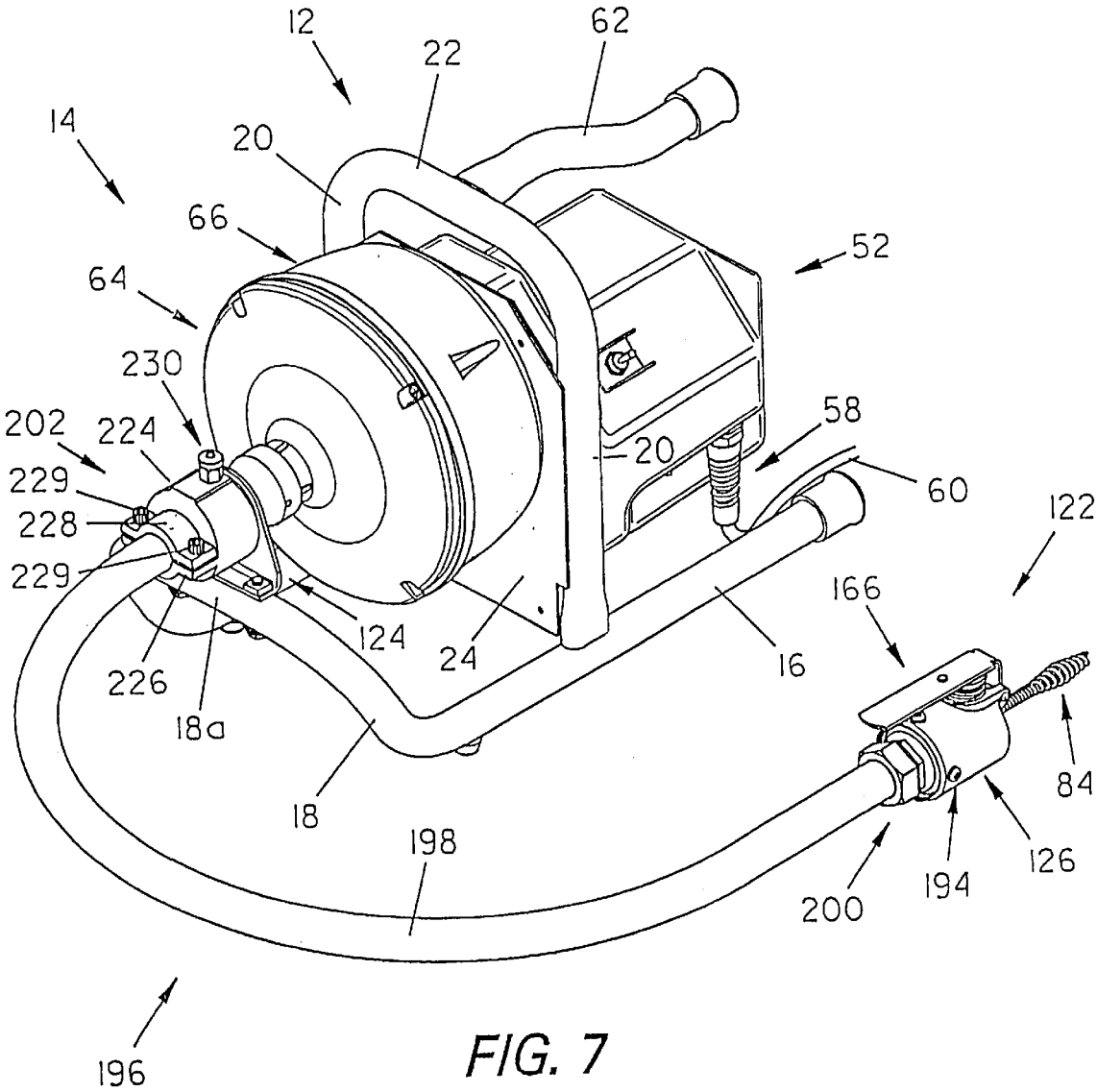
FIG. 7 is a perspective view of one embodiment of a flexible guide tube and cable feed attachment for the drain cleaning apparatus.
Figure 8:
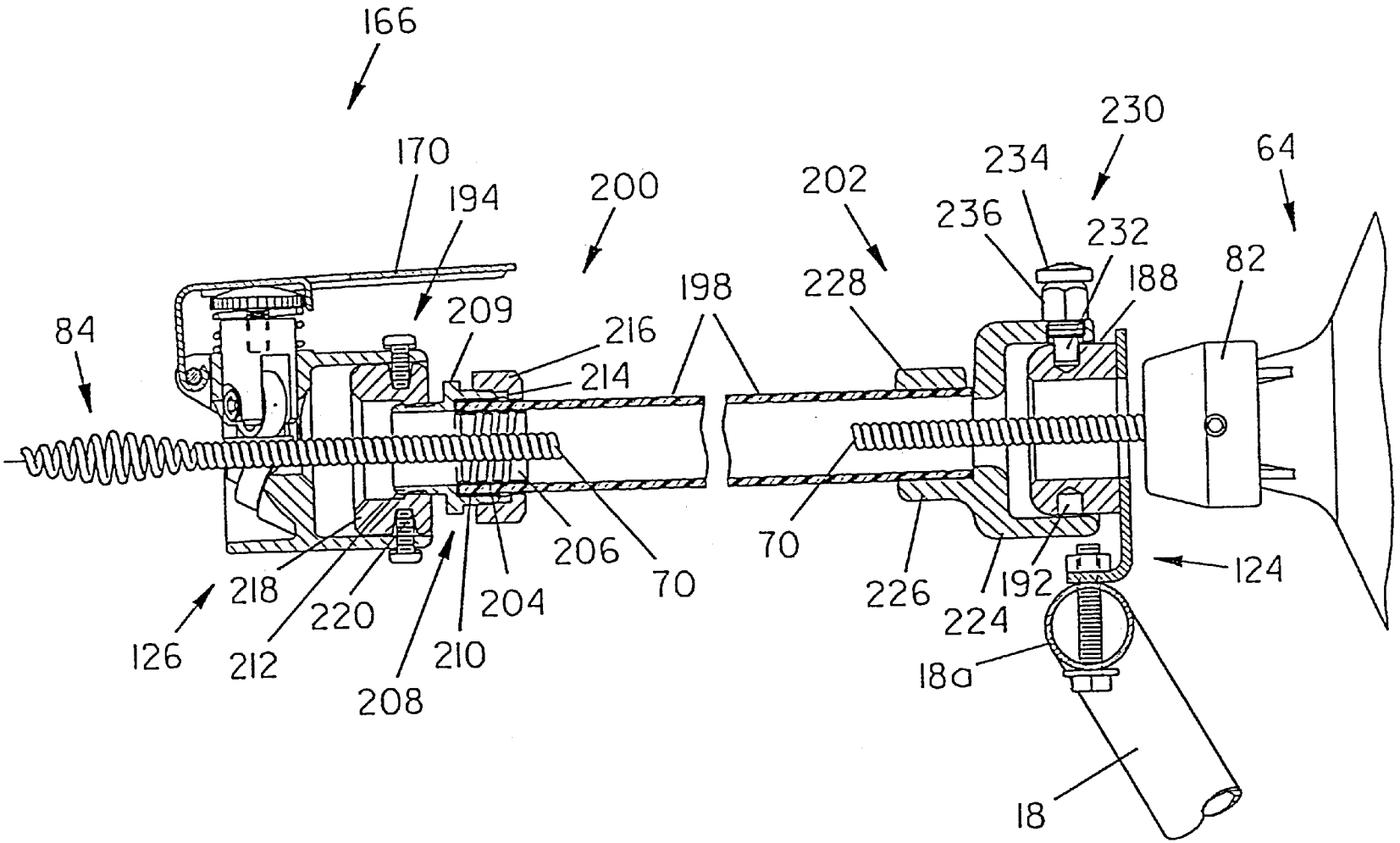
FIG. 8 is a sectional elevation view of the attachment in FIG. 7.

In accordance with yet another aspect of the invention, as shown in FIGS. 7 and 8 of the drawing, drain cleaning cable feed device 122 is mounted on the outer end of a flexible guide tube assembly 196 having its inner end detachably connected to adaptor 188 of mounting bracket 124. More particularly, guide tube 196 comprises a flexible hose 198 having coupling arrangements 200 and 202 on the opposite ends of the hose and which respectively provide the axially outer and axially inner ends of the flexible guide tube. Coupling arrangement 200 comprises a ferrule axially received on the outer end of hose 198 and including an inner sleeve 206 extending axially inwardly of the hose, and a connector member 208 having a central flange 209, a recess 210 on one side thereof receiving ferrule 204, and an externally threaded sleeve 212 on the other side thereof. Coupling arrangement 200 further includes a gland ring 214 and a compression nut 216 by which ferrule 204 and thus the corresponding end of hose 198 is attached to connector member 208, and a tubular mounting collar 218 which is internally threaded at one end for threaded interengagement with externally threaded sleeve 212 of connector member 208. Mounting collar 218 is axially received in inner end 130 of housing 126 of the cable feed device and is provided with an outwardly open annular recess 220 which is adapted to receive the inner ends of fasteners 194 provided on housing 126 in diametrically opposed pairs. The inner ends of fasteners 194 and recess 220 are dimensioned for the fasteners to slide circumferentially in the recess, whereby an operator can rotate cable feed device 122 about the axis of the flexible guide tube.

Coupling arrangement 202 comprises a mounting collar having an axially outer end 224 for receiving adaptor 188 of mounting bracket 124 and having an axially inner end which is necked in to provide a cradle 226 underlying the corresponding end of hose 198. A hose clamp 228 and fasteners 229 secure hose 198 to cradle 226 and thus the mounting collar. Collar 224 supports a spring biased mounting plunger 230 which includes a post 232 extending radially through an opening therefor in collar 224 and into one of the bores 192 in adaptor 188. The plunger includes an operating member 234 on the radially outer end of post 232, and a spring unit 236 normally biases post 232 radially inwardly of bore 192. Accordingly, it will be appreciated that the guide tube and cable feed device can readily be detached from the drain cleaning apparatus by pulling outwardly on operating member 234 to withdraw post 232 from bore 192 so as to free the mounting collar 224 for axial separation from adaptor 188. As will be appreciated from FIG. 8, when the guide tube is mounted on the drain cleaning apparatus, drain cleaning cable 70 is adapted to extend through the flexible hose and coupling arrangements and outwardly through feed device 122 which is operable in the manner described hereinabove to displace the cable axially in response to rotation of the cable drum assembly. Hose 198 can be of any desired length and, preferably, has a length of about three feet which advantageously enables the operator to hold feed device 122 in one hand and to flex the guide tube as is necessary to direct outer end 84 of the cable into a drain or waste line to be cleaned. Accordingly, the operator can perform a drain cleaning operation without having to physically touch the drain cleaning cable.

Figure 9:
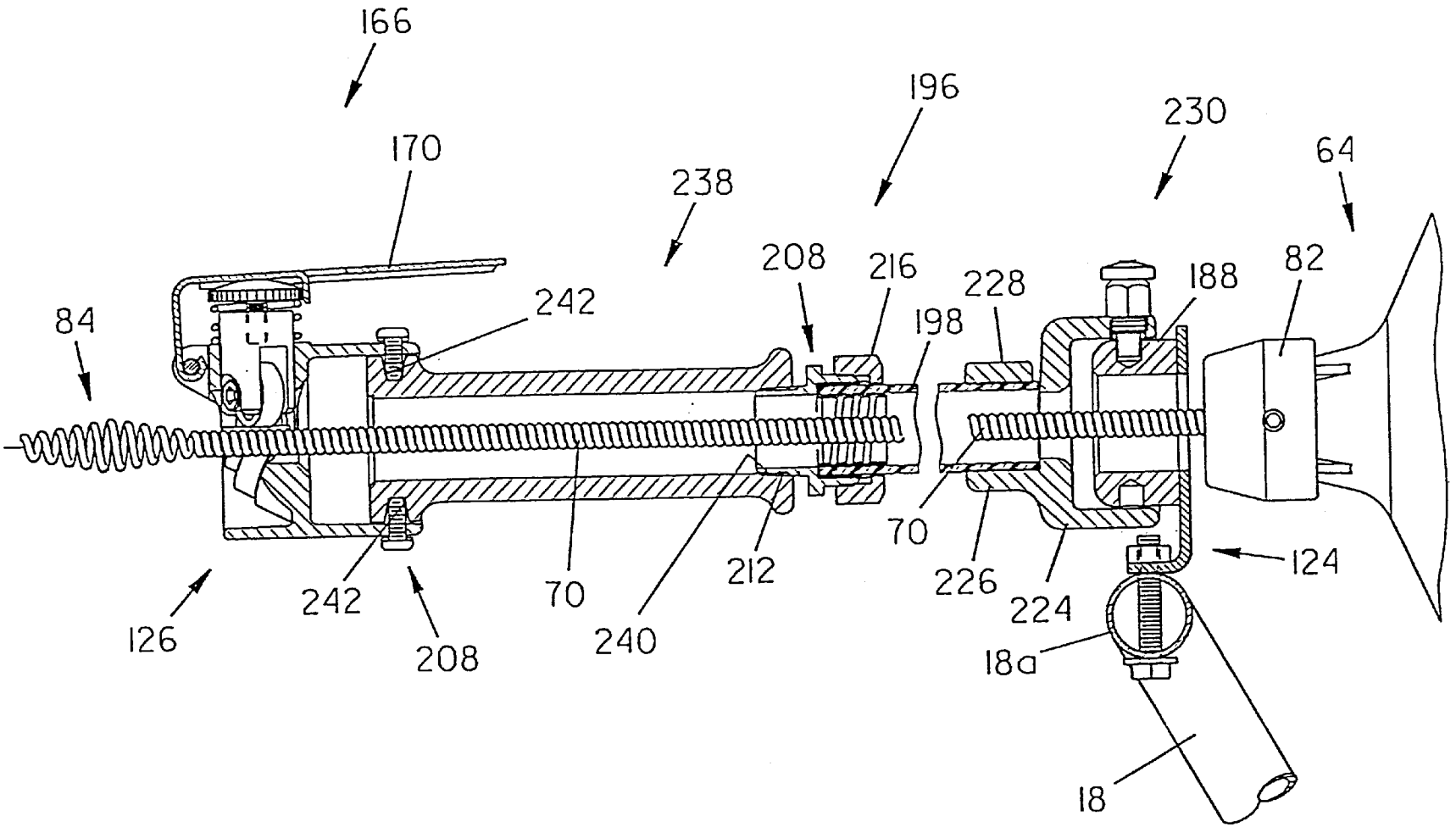
FIG. 9 is a sectional elevation view showing a modification of the flexible guide tube attachment.

FIG. 9 illustrates a modification of the flexible guide tube shown in FIGS. 7 and 8 and, in this respect, illustrates a hand grip component 238 which replaces mounting collar 218 of the guide tube assembly shown in the latter figures. Hand grip 238 is a tubular metal member having an axial length and outer diameter to accommodate an operators hand and is provided at one of the opposite ends thereof with internal threads 240 for threaded interengagement with externally threaded collar 212 of connector member 208. The other end of the hand grip is provided with a radially outwardly open circumferential recess 242 which receives and cooperates with fasteners 194 on the feed device housing to support the feed device for rotation about the axis of the guide tube as described hereinabove in connection with the embodiment of FIGS. 7 and 8.

While considerable emphasis has been placed herein on the structures and structural interrelationships between the component parts of the preferred embodiments of the invention, it will be appreciated that other embodiments as well as modifications of the embodiments disclosed herein can be made without departing from the principles of the invention. In this respect, it will be appreciated that the flexible guide tube can be used with drain cleaning apparatus independent of a torque arm on the inner end of the drain cleaning cable in the cable drum. Likewise, it will be appreciated that a torque arm according to the invention can be used in conjunction with the detached end of a cable wound in a cable drum per se as opposed to a cartridge removably mounted in a drum housing. Further, it will be appreciated that structures other than the fingers and nut disclosed herein can be used to provide a collar for mounting the torque arm on the drain cleaning cable. These and other modifications of the preferred embodiments as well as other embodiments of the invention will be obvious and suggested to those skilled in the art from the disclosure herein, whereby it is to be distinctly understood that the foregoing descriptive matter is to be interpreted merely as illustrative of the present invention and not as a limitation.

Having thus described the invention, it is so claimed:

1. Drain cleaning apparatus comprising a frame, a cable drum supported on said frame for rotation about a drum axis, said drum having axially spaced front and rear ends and an opening through said front end, a drain cleaning cable coiled in said drum about said axis and having an end for extending through said opening and into a drain to be cleaned, a drive mechanism on said frame to rotate said drum and cable, a flexible guide tube to receive said end of said cable, said guide tube having an inner end and an outer end spaced from said inner end, means supporting said inner end of said guide tube for rotation of said drum relative thereto, and a manually operable cable feed device on said outer end of said guide tube for selectively axially displacing said cable relative to said drum during rotation of said drum and cable about said drum axis.

2. The drain cleaning apparatus as defined in claim 1, wherein said drive mechanism includes a drive motor supported on said frame.

3. The drain cleaning apparatus as defined in claim 1, wherein said frame includes a frame portion outwardly of said opening, said inner end of said guide tube being attached to said frame portion.

4. The drain cleaning apparatus as defined in claim 1, wherein said feed device comprises a housing having a housing axis and a passage axially therethrough to receive said cable, cable driving roll mechanism supported on said housing, and drive actuating mechanism supported on said housing to relatively displace said cable and said cable driving roll mechanism into driving interengagement.

5. The drain cleaning apparatus as defined in claim 4, wherein said drive actuating mechanism is radially displaceable relative to said housing for displacing said cable against said driving roll mechanism.

6. The drain cleaning apparatus as defined in claim 5, and means for biasing said drive actuating mechanism radially outwardly of said passage.

7. The drain cleaning apparatus as defined in claim 6, wherein said drive actuating mechanism includes radially outer and inner ends and lever mechanism on said housing to engage said outer end and radially displacing said inner end inwardly of said passage against said cable.

8. The drain cleaning apparatus as defined in claim 5, wherein said cable driving roll mechanism includes a pair of cable driving rolls each mounted on said housing for rotation about a drive roll axis radially fixed relative to said opening, and said drive actuating mechanism includes a drive actuating roll rotatable about an actuating roll axis.

9. The drain cleaning apparatus as defined in claim 8, wherein each said drive roll axis and said actuating roll axis is skewed relative to said housing axis, and each of said cable driving rolls and said actuating roll has a smooth outer surface.

10. The drain cleaning apparatus as defined in claim 1, further including a mounting bracket on said frame, said guide tube including a hose of elastomeric material having opposite ends, said inner end of said guide tube comprising a coupling mechanism on one of said ends of said hose to connect said hose to said mounting bracket, and said outer end of said guide tube comprising a coupling mechanism on the other end of said hose to connect said hose to said feed device.

11. The drain cleaning apparatus as defined in 10, wherein said feed device comprises a housing having a housing axis and a passage axially therethrough for receiving said cable, a cable driving roll mechanism supported on said housing, a drive actuating mechanism supported on said housing for radially displacing said cable against said cable driving roll mechanism, said drive actuating mechanism having radially inner and outer ends, and a lever mechanism pivotally mounted on said housing for engaging said outer end and radially displacing said drive actuating mechanism against said cable.

12. The drain cleaning apparatus as defined in claim 11, wherein said coupling mechanism on one of said ends of said hose is a first coupling arrangement and said coupling mechanism on the other end of said hose includes a second coupling arrangement, and an interconnector to interconnect said second coupling arrangement and said housing to enable said feed device to be rotatable relative to said hose.

13. The drain cleaning as defined in claim 12, wherein said housing includes a tubular end portion having an axis and axially receiving said second coupling arrangement, and said interconnector interconnecting said second coupling arrangement and said housing includes a peripheral recess in said second coupling arrangement coaxial with said axis of said end portion and a plurality of pins extending radially inwardly of said end portion into said recess.

14. The drain cleaning as defined in claim 13, wherein said cable driving roll mechanism includes a pair of cable driving rolls each mounted on said housing for rotation about a drive roll axis radially fixed relative to said opening and wherein said drive actuating mechanism includes a drive actuating roll providing said inner end thereof and rotatable about an actuating roll axis.

15. The drain cleaning as defined in claim 14, wherein each said drive roll axis and said actuating roll axis is skewed relative to said housing axis, and each of said cable driving rolls and said actuating roll has a smooth outer surface.

16. The drain cleaning as defined in claim 11, wherein said coupling mechanism on the other end of said hose includes a tubular hand grip having an inner end connected to said other end of said hose and having an outer end, and an interconnector to interconnect said outer end of said hand grip and said housing for said feed device to be rotatable relative to said hose.

17. The drain cleaning apparatus as defined in claim 16, wherein said housing includes a tubular end portion having an axis and axially receiving said outer end of said hand grip, and said interconnector interconnecting said outer end of said hand grip and said housing includes a peripheral recess in said outer end of said hand grip coaxial with said axis of said end portion and a plurality of pins extending radially inwardly of said end portion into said recess.

18. The drain cleaning apparatus as defined in claim 1, and an interconnector to interconnect said feed device and said outer end of said guide tube for said feed device to be rotatable relative to said guide tube.

19. The drain cleaning apparatus as defined in claim 18, wherein said feed device includes a housing having a tubular end portion having an axis and axially receiving said outer end of said guide tube, said interconnector interconnecting said feed device and said outer end, a peripheral recess in said outer end of said guide tube coaxial with said axis of said end portion of said housing, and a plurality of pins extending radially inwardly of said end portion into said recess.

20. The drain cleaning apparatus as defined in claim 18, wherein said outer end of said guide tube includes a tubular hand grip having an outer end, and an interconnector to interconnect said outer end of said hand grip and said feed device for said feed device to be rotatable relative to said guide tube.

21. The drain cleaning as defined in claim 20, wherein said feed device includes a housing having a tubular end portion having an axis and axially receiving said outer end of said hand grip, and said interconnector interconnecting said outer end of said hand grip and said feed device, a peripheral recess in said outer end of said hand grip coaxial with said axis of said end portion, and a plurality of pins extending radially inwardly of said end portion into said recess.

22. Drain cleaning apparatus comprising a frame, a cable drum supported by the frame for rotation about a drum axis, the drum having axially spaced front and rear ends and an opening through the front end, a drain cleaning cable coiled in the drum about the drum axis and having an end for extending through the drum opening, a drive motor supported by the frame for rotating the drum and cable, a guide tube to receive the end of the cable, the guide tube having a first end adjacent the drum opening and a second end spaced from the drum opening, the guide tube being flexible between the first and second ends to direct the cable toward a drain to be cleaned, and a manually operable cable feed device coupled to the second end of the guide tube to selectively axially displace the cable relative to the guide tube during rotation of the drum and cable about the drum axis, said end of said cable extending into the first end of the guide tube and out of the second end of the guide tube.

23. A drain cleaner, comprising:

an apparatus having a frame and a cable drum assembly supported by the frame;

a motor supported by the frame and coupled to the drum assembly;

a cable guide tube flexible between its ends and having one end mounted on the apparatus; and, a manually operable cable feed device connected to the free end of the guide tube for selectively axially displacing a drain cleaning cable relative to the drum assembly in response to rotation of the drum assembly.

24. The drain cleaner of claim 23, wherein the guide tube is detachably mounted to the frame.

25. The drain cleaner of claim 24, wherein the guide tube is detachably mounted to a portion of the frame that extends horizontally across the front end of the drum assembly and below an opening in the drum assembly.

26. The drain cleaner of claim 23, wherein the motor is coupled to the drum assembly by a belt and pulley system.

27. The drain cleaner of claim 23, further comprising a drain cleaning cable, a portion of which is stored within the drum assembly.

28. The drain cleaner of claim 27, further comprising a torque arm connected to the drain cleaning cable adjacent one end and located within the drum assembly.

29. The drain cleaner of claim 23, wherein the feed device can be held by an operator with one hand and manually operated for selective axial feeding with that same hand.

30. A drain cleaning apparatus, comprising:

a cable drum assembly;

a motor coupled to the drum assembly for rotating the drum assembly about an axis;

a cable guide tube having one end mounted on the apparatus, the guide tube being flexible between its ends such that an operator can direct the free end of the guide tube toward a drain to be cleaned;

a manually operable cable feed device connected to the free end of the guide tube for selectively axially displacing a drain cleaning cable relative to the drum assembly in response to rotation of the drum assembly; and, whereby the operator can hold the feed device in one hand, flex the guide tube as necessary toward the drain to be cleaned, and advance and retract the cable relative to the drum assembly without having to physically contact the cable.

31. The drain cleaning apparatus of claim 30, wherein the guide tube is detachably mounted to a frame that supports the motor and drum assembly.

32. The drain cleaning apparatus of claim 31, wherein the guide tube is detachably mounted to a portion of the frame that extends horizontally across the front end of the drum assembly and below an opening in the drum assembly.

33. The drain cleaning apparatus of claim 30, further comprising a drain cleaning cable, a portion of which is stored within the drum assembly.

34. The drain cleaning apparatus of claim 33, further comprising a torque arm connected to the drain cleaning cable adjacent one end and located within the drum assembly.

35. A guide tube assembly for a cable drain cleaning apparatus, comprising:

a flexible guide tube having a connector at one end for coupling the guide tube to the drain cleaning apparatus and having another, free end;

a manually operable cable feed device coupled to the free end of the flexible guide tube, said feed device capable of selectively feeding the cable through the guide tube in response to rotation of the cable within the guide tube.

36. The guide tube assembly of claim 35, wherein the flexible guide tube is elastomeric.

37. The guide tube assembly of claim 35, wherein the free end of the guide tube further comprises a connector for detachably coupling the cable feed device to the guide tube.

38. The guide tube assembly of claim 35, wherein the cable feed device is configured to be held in one hand and to be selectively actuated by that same hand.

* * * * *

UNITED STATES PATENT AND TRADEMARK OFFICE

CERTIFICATE OF CORRECTION

PATENT NO. : 6,412,136 B1
DATED : July 2, 2002
INVENTOR(S) : Rutkowski

It is certified that error appears in the above-identified patent and that said Letters Patent is hereby corrected as shown below:

Column 9,
Line 37, before the second appearance of “cable” insert -- a --;
Line 38, after “and” insert -- a --; and
Line 50, after the second appearance of “and” insert -- a --.

Column 10,
Lines 24, 32, 39 and 44, after “cleaning” insert -- apparatus --.

Column 11,
Line 11, after “cleaning” insert -- apparatus --.

Signed and Sealed this

Twenty-second Day of July, 2003

JAMES E. ROGAN
*Director of the United States Patent and Trademark Office*